US006216314B1

(12) United States Patent
Dangerfield

(10) Patent No.: US 6,216,314 B1
(45) Date of Patent: Apr. 17, 2001

(54) DEVICE FOR REMOVING ACCUMULATED GREASE FROM CULINARY UTENSILS

(76) Inventor: John N. Dangerfield, 7735 Glen Oaks Dr., Baton Rouge, LA (US) 70805

( * ) Notice: Subject to any disclaimer, the term of this patent is extended or adjusted under 35 U.S.C. 154(b) by 0 days.

(21) Appl. No.: 09/386,631

(22) Filed: Aug. 31, 1999

(51) Int. Cl.[7] ..... A47L 5/26

(52) U.S. Cl. ..... 15/344; 15/99; 15/353; 15/380

(58) Field of Search ..... 15/344, 353, 350, 15/380, 99

(56) References Cited

U.S. PATENT DOCUMENTS 2,524,928 * 10/1950 Platz ..... 15/380 X
4,926,515 * 5/1990 Lynn et al. ..... 15/99 X
4,930,178 * 6/1990 Monson et al. ..... 15/344 X
5,099,545 * 3/1992 Krasznai et al. ..... 15/344
5,603,139 * 2/1997 Alazet ..... 15/344 X
5,857,239 * 1/1999 Oh et al. ..... 15/99 X
5,904,160 * 5/1999 Wright ..... 15/344 X

* cited by examiner

*Primary Examiner*—Chris K. Moore
(74) *Attorney, Agent, or Firm*—Kenneth L Tolar

(57) ABSTRACT

A device for removing excess grease from a cooking utensil includes a hollow housing having a vacuum assembly received therein. The housing includes a nozzle tapered towards a vacuum tip that is in communication with an interior storage reservoir. A drain port in communication with the reservoir is disposed on a side of the housing allowing a user to easily drain the reservoir. A second embodiment includes a motor driven belt, a portion of which protrudes from the vacuum tip for absorbing grease.

9 Claims, 2 Drawing Sheets

DEVICE FOR REMOVING ACCUMULATED GREASE FROM CULINARY UTENSILS

BACKGROUND OF THE INVENTION

The present invention relates to a device for removing and collecting grease that accumulates withing cooking utensils.

DESCRIPTION OF THE PRIOR ART

Many food items such as beef, bacon and other substances having a high fat concentration produce a significant amount of grease when heated. The generated grease accumulates within a pot or pan causing the food item to be greasier and less tasteful. Furthermore, disposing of such grease is troublesome. The grease cannot be poured into the sink since the grease will harden and clog drain pipes. Sometimes, it is desirable to save and reuse the grease. However, transferring grease from a pot or pan to another container for collection or disposal is tedious and difficult. The present invention relates to a device which allows a user to quickly transfer accumulated grease from a cooking utensil to a storage container.

Various food preparation devices exist in the prior art. For example, U.S. Pat. No. 5,787,799 issued to Mohrhauser et al relates to a liquid baster including a liquid tube and a squeezable suction bulb.

U.S. Pat. No. 5,638,872 issued to Porter relates to a siphoning device for use in basting, measuring or separating immiscible liquids.

U.S. Pat. No. 5,408,919 issued to Hutzler et al relates to a baster including a cylinder for receiving gravy and a piston reciprocatable within the cylinder to intake and expel gravy.

U.S. Pat. No. 5,394,789 issued to Evans et al relates to a manually operable device for metering air through a valve system.

U.S. Pat. No. 4,129,066 issued to Corley relates to a basting device for injecting fluid including an elongated hollow member with perforations adjacent an end thereof and an annular flange adjacent the other end. Adjacent the perforations is a pointed tip for penetrating a food article. A bowl is threadedly attached to the flange with the flange forming a cover.

U.S. Pat. No. 2,887,035 issued to De Seversky relates to a food seasoning injection device.

As indicated above, various food basting devices exist in the prior art. However, none are capable of quickly withdrawing accumulated grease from a cooking utensil and storing such grease until it can be properly discarded. Furthermore, the present invention is adapted so that the stored grease may be quickly transferred to an external container.

SUMMARY OF THE INVENTION

The present invention relates to a device for removing and storing accumulated grease produced in a cooking utensil. The device comprises a substantially hollow housing having a vacuum assembly therein. The housing includes a tapered nozzle having a narrow, open vacuum tip that may be easily inserted into confined spaces such as around and between food items. Within the nozzle is a grease collection reservoir in communication with the vacuum tip that temporarily stores grease vacuumed into the nozzle. A drain aperture in communication with the reservoir is disposed on a side of the nozzle for draining the reservoir into an external container. In a second embodiment, the nozzle includes a gear driven belt partially protruding from the open vacuum tip that assists in removing grease from the utensil. It is therefore an object of the present invention to provide a device which assists a user in quickly and easily removing accumulated grease from a cooking utensil.

It is another object of the present invention to provide a device which assists a user in disposing of grease generated by heating food items.

It is yet another object of the present invention to provide a device that assists a user in preparing lighter, healthier meals. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
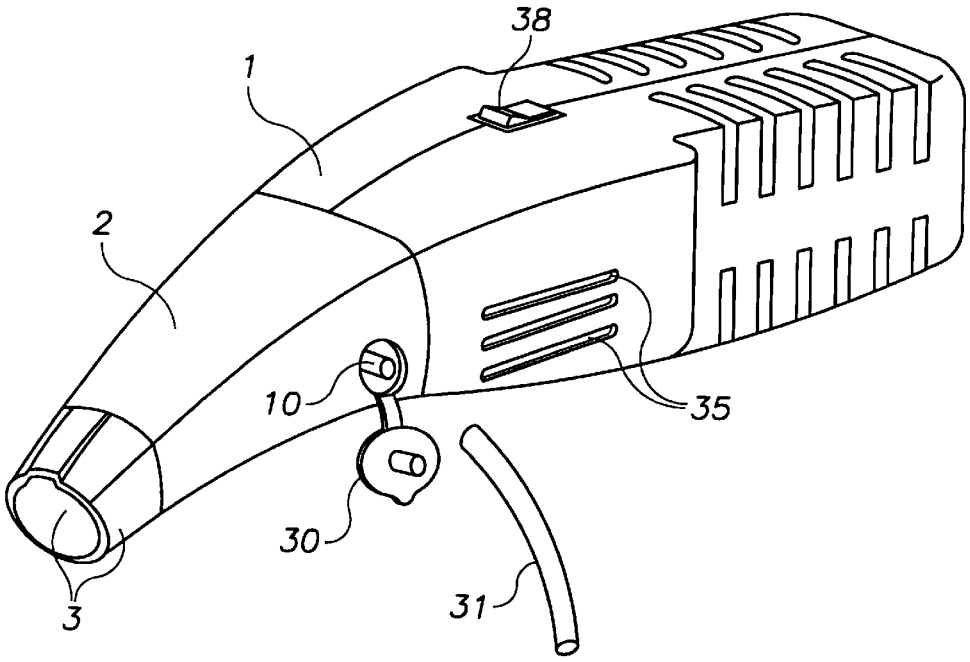
FIG. 1 is a perspective view of the invention.
Figure 2:
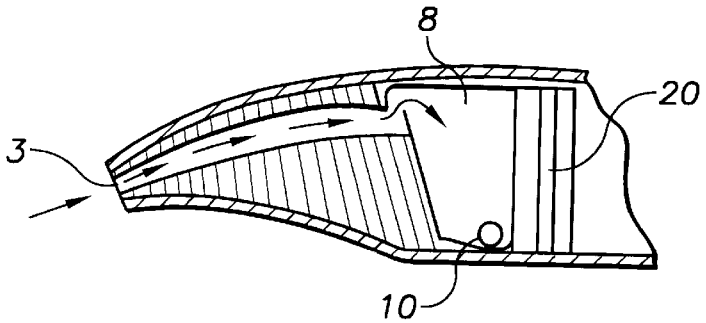
FIG. 2 is a cross sectional side view of the nozzle.
Figure 5:
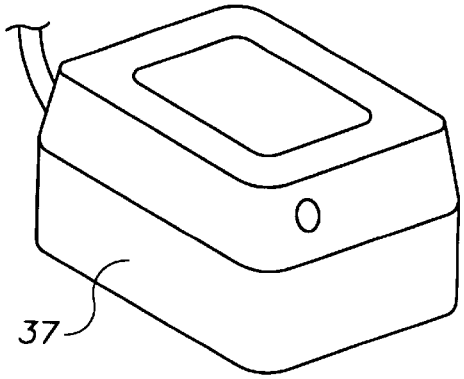
FIG. 5 depicts the recharging support stand.

Referring now to FIGS. 1 through 5, the present invention relates to a device for removing and storing accumulated grease. The device comprises a substantially hollow housing 1 having an elongated nozzle 2. The nozzle is tapered towards and terminates at a vacuum tip 3 having an opening in communication with a reservoir 8 within the housing. Preferably, the nozzle is arcuate and is sloped downwardly from the housing to assist a user in inserting the tip into a pot or pan.

Received within the housing proximal the nozzle portion is a conventional vacuum assembly 20 including a vacuum motor 15, a vacuum impeller 16 for creating a vacuum within the nozzle and a filter 17 separating the vacuum assembly from the reservoir. On a side of the nozzle is a port 10 sealable with a removable cap member 30. The port is in fluid communication with the reservoir whereby the reservoir may be conveniently emptied by simply removing the cap and tilting the housing. In addition, the device may also include an external drain tube 31 adapted to be coupled with the outlet port to assist a user in draining the grease into an external container.

Figure 3:
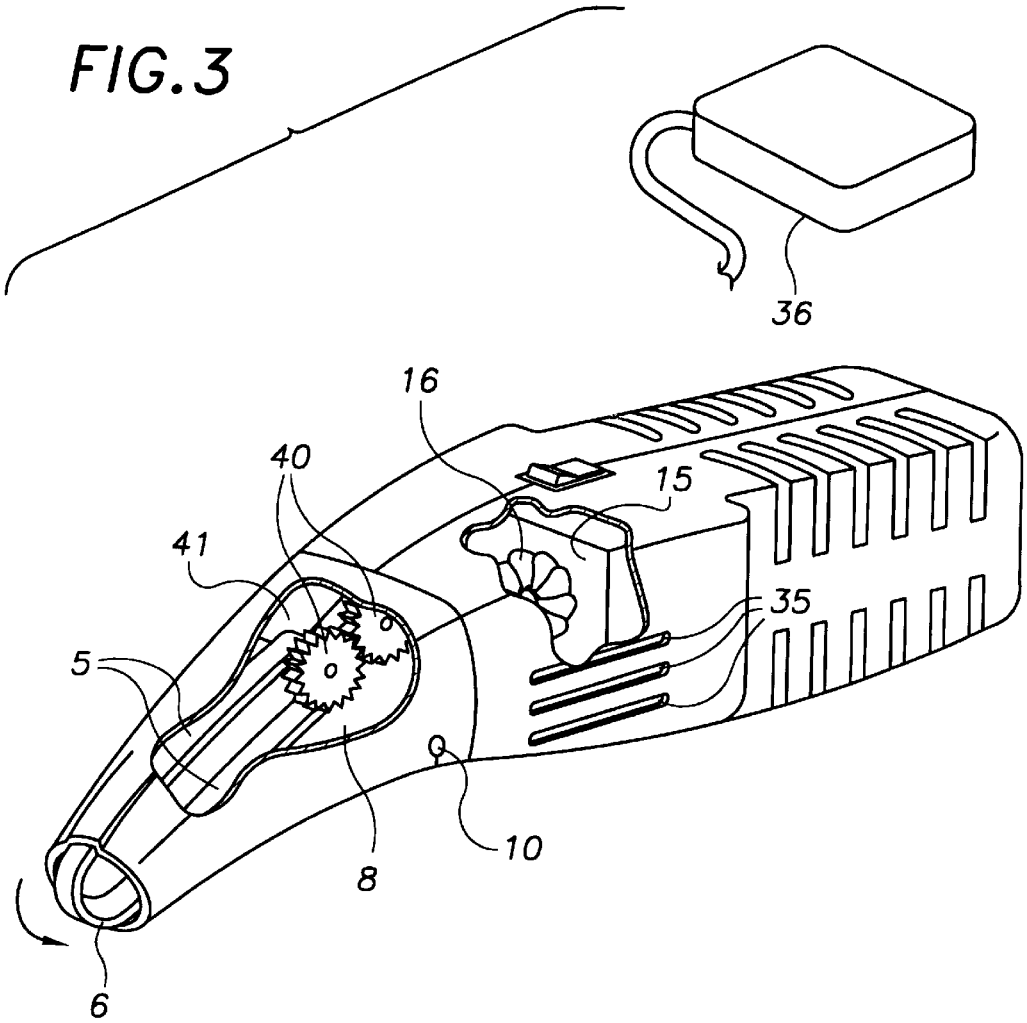
FIG. 3 is a partial cut-away view of the housing according to a second embodiment, depicting the internal components thereof.
Figure 4:
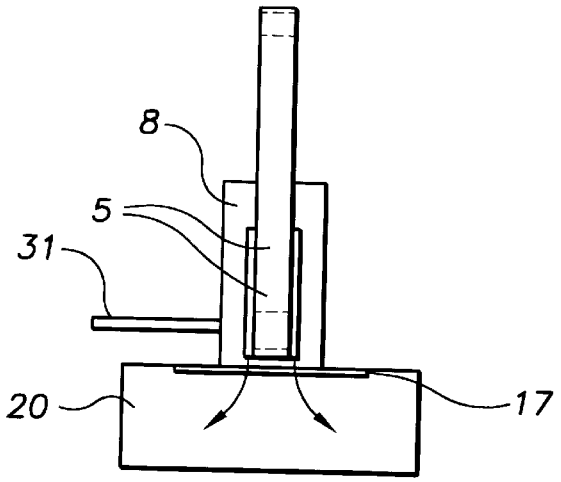
FIG. 4 is a top view of the internal vacuum assembly according to the second embodiment.

A second embodiment is depicted in FIG. 3. Within the nozzle is a motor 41 and gear 40 assembly that rotatably drives an elongated belt 5. The belt is preferably constructed with an absorbent material. A portion of the belt 6 protrudes from the vacuum tip allowing it to contact a grease puddle. In this embodiment, the filter or air intake to the vacuum impeller has a small surface area and is positioned such that a suction is created immediately below the belt. The strategically positioned smaller suction area results in less suction, and therefore less turbulence, at the vacuum tip.

In either embodiment, the housing includes a plurality of air discharge openings 35 for expelling air generated by the vacuum assembly. The device also includes a rechargeable battery 36 for powering the vacuum assembly as well as the gear and motor. The battery is recharged with a DC adapter/holder 37 in which the device can be mounted when not in use. The holder may also include means for mounting the holder to a wall. A switch means 38 activates the vacuum assembly and motorized belt.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A device for removing grease from culinary utensils comprising:

a housing having a vacuum tip in communication with an interior reservoir;

a vacuum means received within said housing for pulling grease through said vacuum tip and into said reservoir;

a drain port on the exterior surface of said housing in fluid communication with said reservoir allowing said reservoir to be selectively drained;

a tube adapted to be coupled with said port for assisting a user in draining said reservoir into an external container.

2. A device according to claim 1 further comprising a motorized, continuous belt received within said housing, a portion of said belt protruding from said vacuum tip, said belt movable along a predetermined path for absorbing grease when said belt is in contact therewith.

3. A device according to claim 1 wherein said housing further includes an arcuate nozzle portion, said nozzle portion tapered towards said vacuum tip allowing said vacuum tip to be easily inserted between tightly spaced objects.

4. A device according to claim 1, further comprising a cap for selectively covering said port.

5. A device for removing grease from culinary utensils comprising:

a housing having a vacuum tip in communication with an interior reservoir;

a vacuum means received within said housing for pulling grease through said vacuum tip and into said reservoir;

a drain port on the exterior surface of said housing in fluid communication with said reservoir allowing said reservoir to be selectively drained;

a motorized, continuous belt received within said housing, a portion of said belt protruding from said vacuum tip, said belt movable along a predetermined path for absorbing grease when said belt is in contact therewith.

6. A device according to claim 5 wherein said housing further includes an arcuate nozzle portion, said nozzle portion tapered towards said vacuum tip allowing said vacuum tip to be easily inserted between tightly spaced objects.

7. A device according to claim 5 further comprising a cap for selectively covering said port.

8. A device for removing grease from culinary utensils comprising:

a housing having a vacuum tip in communication with an interior reservoir;

a vacuum means received within said housing for pulling grease through said vacuum tip and into said reservoir;

a drain port on the exterior surface of said housing in fluid communication with said reservoir allowing said reservoir to be selectively drained;

an arcuate nozzle portion, said nozzle portion tapered towards said vacuum tip allowing said vacuum tip to be easily inserted between tightly spaced objects.

9. A device according to claim 8 further comprising a cap for selectively covering said port.

* * * * *